US008506343B2

(12) United States Patent
Goff et al.

(10) Patent No.: US 8,506,343 B2
(45) Date of Patent: Aug. 13, 2013

(54) INTERACTIVE TOY DOLL FOR IMAGE CAPTURE AND DISPLAY

(75) Inventors: Christopher L. Goff, Redondo Beach, CA (US); Paul King, Newbury Park, CA (US); Jeffrey H. Levine, Los Angeles, CA (US); Eric Skifstrom, Manhattan Beach, CA (US); Erich Weidetz, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 318 days.

(21) Appl. No.: 12/771,879

(22) Filed: Apr. 30, 2010

(65) Prior Publication Data

US 2011/0269365 A1 Nov. 3, 2011

(51) Int. Cl.
*A63H 30/00* (2006.01)
*G03B 19/00* (2006.01)

(52) U.S. Cl.
USPC ..... 446/175; 446/268; 446/484; 396/429

(58) Field of Classification Search
USPC ..... 446/175, 268, 484, 297; 369/429; 396/429
See application file for complete search history.

(56) References Cited

U.S. PATENT DOCUMENTS

| | | | | |
|---|---|---|---|---|
| D270,839 | S | 10/1983 | Greif | |
| 4,736,220 | A | 4/1988 | Heinzelmann | |
| 4,819,076 | A | 4/1989 | Briggs | |
| 4,864,333 | A | 9/1989 | Barber | |
| 4,982,281 | A | 1/1991 | Gutierrez | |
| 5,111,290 | A | 5/1992 | Gutierrez | |
| 5,738,526 | A | 4/1998 | Cerda et al. | |
| 5,991,547 | A | 11/1999 | Baiera et al. | |
| 6,064,421 | A | 5/2000 | Pohl | |
| 6,264,379 | B1 | 7/2001 | Rydelek et al. | |
| 6,264,521 | B1 * | 7/2001 | Hernandez | 446/73 |
| 6,535,793 | B2 | 3/2003 | Allard | |
| 6,547,624 | B1 * | 4/2003 | Bojesen et al. | 446/85 |
| 6,554,679 | B1 | 4/2003 | Shackelford et al. | |
| 6,568,983 | B1 | 5/2003 | Peters | |
| 6,656,049 | B1 * | 12/2003 | Masaki et al. | 463/36 |
| 6,746,304 | B1 | 6/2004 | Liu | |

(Continued)

FOREIGN PATENT DOCUMENTS

WO 89/04708 6/1989

OTHER PUBLICATIONS

K.T. Bradford, Video Girl Barbie Will Turn Your Kid Into a Dirctor, Feb. 15, 2010, 1 page PDF (http://blog.laptopmag.com/video-girl-barbie-will-turn-your-kid-into-a-director).*

(Continued)

*Primary Examiner* — Dmitry Suhol
*Assistant Examiner* — Alex F. R. P. Rada, II
(74) *Attorney, Agent, or Firm* — Kolisch Hartwell, PC

(57) ABSTRACT

An interactive toy doll is provided having a torso defining a front portion and a back portion. The doll may additionally include legs extending from a lower portion of the torso, an image sensor located on the front portion of the torso, and an image display located on the back portion of the torso. The doll may further include a processor operatively connected to the image sensor and the image display. Additionally, the doll may include legs that may be grasped by a user while leaving the image sensor and the image display exposed so that a user may view an image on the image display while grasping the legs.

13 Claims, 3 Drawing Sheets

(56) References Cited

U.S. PATENT DOCUMENTS

| | | | | |
|---|---|---|---|---|
| 6,997,773 | B1 | 2/2006 | Dubois et al. | |
| 7,062,073 | B1 * | 6/2006 | Tumey et al. | 382/118 |
| 7,447,564 | B2 | 11/2008 | Yasukawa et al. | |
| 2001/0004577 | A1 | 6/2001 | Lewis | |
| 2002/0111117 | A1 | 8/2002 | Ho et al. | |
| 2003/0016286 | A1 | 1/2003 | Liu et al. | |
| 2006/0246814 | A1 * | 11/2006 | Todokoro | 446/81 |
| 2006/0293102 | A1 | 12/2006 | Kelsey | |
| 2007/0046774 | A1 | 3/2007 | Silva et al. | |
| 2007/0065142 | A1 * | 3/2007 | Liang | 396/429 |
| 2007/0128979 | A1 | 6/2007 | Shackelford et al. | |
| 2008/0176481 | A1 | 7/2008 | Zebersky | |
| 2008/0252726 | A1 | 10/2008 | Chan et al. | |
| 2009/0197504 | A1 * | 8/2009 | Hsu | 446/301 |
| 2009/0209170 | A1 * | 8/2009 | Richter | 446/297 |
| 2011/0130069 | A1 * | 6/2011 | Rollin | 446/297 |
| 2012/0315820 | A1 * | 12/2012 | Goff et al. | 446/297 |

OTHER PUBLICATIONS

Internet Archieve (http://wayback.archive.org/web/*/http://blog.laptopmag.com/video-girl-barbie-will-turn-your-kid-into-a-director), 8 pages PDF.*

K.T. Bradford, Video Girl Barbie Will Turn Your Kid Into a Dirctor, Feb. 15, 2010, 5 drawings PDF.*

* cited by examiner

INTERACTIVE TOY DOLL FOR IMAGE CAPTURE AND DISPLAY

FIELD OF THE DISCLOSURE

The present disclosure relates generally to interactive toys for image capture and display and, more particularly, to interactive toy dolls with an integral video camera and image display.

BACKGROUND

Children enjoy a variety of toy action figures and dolls that can be manipulated to simulate real life activities. Often these dolls allow children to simulate activities the children are not yet able to participate in themselves.

One way of increasing the enjoyment of these activities and available play options is to provide dolls that are capable of capturing and displaying a video image of these simulated real life activities. Examples of toys/devices for capturing and displaying a video image are found in U.S. Pat. Nos. 4,982,281, 5,289,273, 6,264,521; and in U.S. Publication No. US20030016286; and in published patent application No. FR2703205. The disclosures of these and all other publications referenced herein are incorporated by reference in their entirety for all purposes.

SUMMARY

In one example, an interactive toy doll for image capture and display is provided having a torso that may include a sternum region located on a front portion of the torso and a thoracic region located on a back portion of the torso, generally aligned with the sternum region. The torso may additionally include a lumbar region located on the back portion of the torso, generally below the thoracic region. A camera lens may be integrated into the sternum region, and optically connected to an image sensor supported inside the torso. An image display may be integrated into the thoracic region and operatively connected to the image sensor. The torso may further include a control panel integrated into the lumbar region, operatively interconnected to the image sensor and the image display, and including at least one manual input so that the image sensor and the image display may be controlled using the control panel.

In some embodiments the toy doll may include a microphone integrated into the sternum region and operatively connected to the image sensor; a processor operatively connected to the image sensor and the image display; an image memory operatively connected to the processor; an electrical connector integrated into the torso and operatively connected to the processor; and a power source operatively connected to the processor.

In other embodiments the toy doll may include a torso defining a front portion of the torso and a back portion of the torso; legs extending from a lower portion of the torso; an image sensor located on the front portion of the torso; an image display located on the back portion of the torso; and a processor operatively connected to the image sensor and the image display. Additionally, the toy doll may include legs that may be grasped by a user while leaving the image sensor and the image display exposed so that a user may view an image on the image display while grasping the legs.

There may also be various methods of playing with the toy doll that may include the steps of providing a toy doll including a torso that may have an image sensor and an image display integrated into opposing surfaces of the torso, with legs extending from a lower portion of the torso. The steps may additionally include grasping the legs while leaving the image sensor and the image display exposed; pressing a control input on the lower portion of the torso; capturing a sensed image using the image sensor; transmitting the sensed image to the image display; viewing the sensed image on the image display; outputting the sensed image to a computer; and editing the sensed image on the computer.

An interactive toy doll as disclosed provides a revolutionary new way for a user to play with an interactive toy doll by combining a traditional toy doll with an integrated video camera and image display. A user playing with an interactive toy doll may use an interactive toy doll to capture videos of another user, other interactive toy dolls in play, and/or simulated real life activities. Later, a user may upload captured videos to a computer, edit the videos using software, and share video files over the Internet using such services as YouTube.

DETAILED DESCRIPTION

Figure 1:
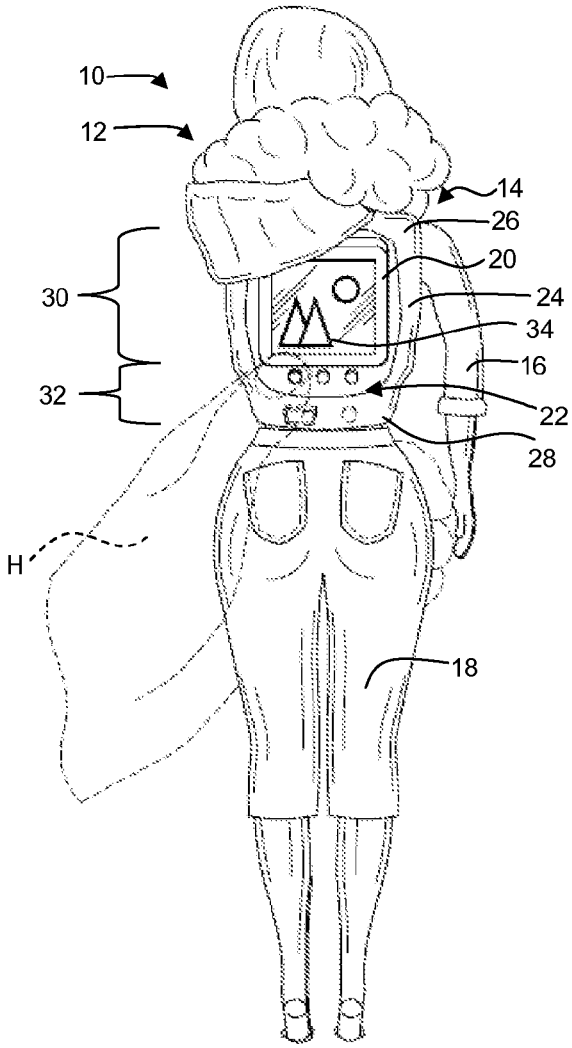
FIG. 1 is a rear perspective view of a nonexclusive illustrative example of an interactive toy doll being grasped by a user.

FIG. 1 shows an interactive toy doll 10 having a body 12 including a torso 14, arms 16, and legs 18. Doll 10 includes an image display 20 and a control panel 22 located on a back portion 24 of torso 14. Image display 20 may be a color liquid crystal display (LCD), as is known in the art, but other types of electronic displays may be used, including LED displays or monochromatic displays.

Torso 14 is labeled in FIG. 1 to represent an upper portion 26 and a lower portion 28. More specifically, upper portion 26 may include a thoracic region 30, and lower portion 28 may include a lumbar region 32. A particularly convenient and useful configuration of toy 10 includes image display 20 integrated into thoracic region 30, and control panel 22 integrated into lumbar region 32.

Legs 18 extend from lower portion 28 of torso 14, and may be grasped by a user, as represented in FIG. 1 by a hand H, while leaving image display 20 exposed so that a user may view an image 34 on image display 20 while grasping legs 18. This allows a user to play with doll 10, as is typical for a child, while enjoying the play-value of an integral video camera and image display, as discussed in more detail below.

Figure 2:
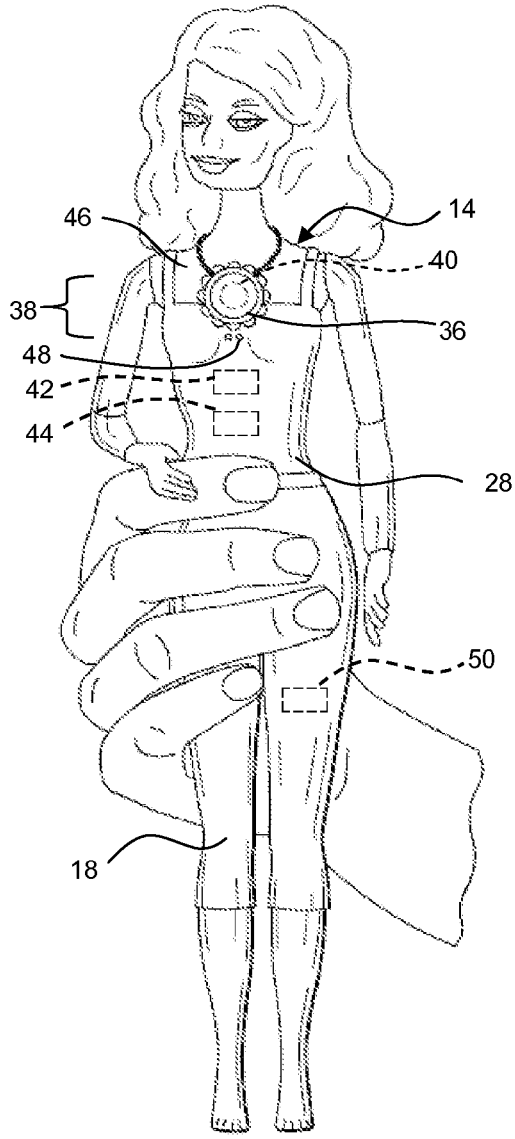
FIG. 2 is a front perspective view of the doll of FIG. 1.

FIG. 2 shows a front view of doll 10, having a camera lens 36 integrated into a sternum region 38 of doll 10. An image sensor 40, represented in dashed lines, is optically connected to camera lens 36, and may include a charge coupled device (CCD), as is known in the art. Other types of image sensors, with higher or lower resolution, may be used as needed. A processor 42 is operatively connected to image display 20 and image sensor 40, and is supplemented by an image memory 44.

Preferably, image sensor 40, processor 42, and image memory 44 are part of an integrated circuit or circuits, and are operatively connected to image display 20 and control panel 22 by a printed wiring assembly, or additional wires, not shown.

Image sensor 40 may be integrated into sternum region 38 located on a front portion 46 of torso 14. Additionally and/or alternatively, image sensor 40 may be supported inside torso 14 and optically connected to camera lens 36. Audio sensing may be provided by a microphone 48, represented in FIG. 2 by two small holes. Microphone 48 may be operatively connected to image sensor 40, and may be generally located on front portion 46 and/or integrated into sternum region 38. In addition, sternum region 38 may include a necklace or other ornamentation to at least partially camouflage and/or disguise image sensor 40, camera lens 36, and/or microphone 48.

Processor 42 may be capable of processing both sensed images captured by image sensor 40 and audio captured by microphone 46, and then storing captured image and audio information on image memory 44. Processor 42 and image memory 40 may be housed within torso 14. In some embodiments, doll 10 may include a card slot for image memory expansion. Various memory cards are available, with microSD cards being particularly convenient and small.

FIG. 2 shows legs 18 extending from lower portion 28 of torso 14, as in FIG. 1. Preferably, legs 18 may be grasped by a user while leaving image sensor 40 and image display 20 (shown in FIG. 1) exposed so that a user may view image 34 (shown in FIG. 1) on image display 20 (shown in FIG. 1) while grasping legs 18.

Doll 10 may further include a power-source 50 housed in one or more legs 18, and operatively connected to processor 42. Power-source 50 may include one or more AAA batteries, rechargeable batteries, or USB chargeable power-source.

In FIGS. 1 and 2, torso 14, legs 18, and image display 20 are shown fixed relative to one another. However, it is common for torso 14 and legs 18 to be connected by a swivel joint or ball joint, with additional joints at various locations within arms 16 and legs 18. Other embodiments of an interactive toy doll may include a different appearance and/or shape.

Figure 3:
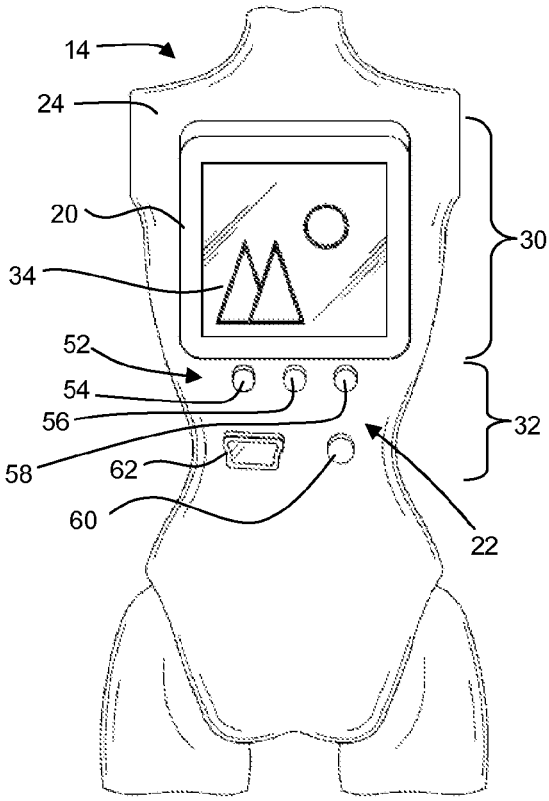
FIG. 3 is a rear view of a torso region of the doll of FIGS. 1 and 2.

FIG. 3 shows back portion 24 of torso 14 including image display 20 that may be integrated into thoracic region 30, and control panel 22 that may integrated into lumbar region 32. Control panel 22 may include one or more manual inputs 52 operatively connected to processor 42 that may be pressed to perform such functions as recording image 34, playing and/or displaying image 34, deleting image 34 from image memory 44, and resetting and/or restarting processor 42.

Some functionality of control panel 22 will be described next. For the purposes of this description captured image and/or audio information will additionally be referred to as video, a video, or video file.

Manual inputs 52 may include one or more of the following: a trash button 54, a record button 56, a play button 58, and a reset button 60. Reset button 60 may be used to power-off doll 10, otherwise doll 10 may power-off after a certain amount of inactivity.

Manual inputs 52 may be pressed to perform some of the following functions. To power-on doll 10, a user may press, hold, and release record button 56. Once powered on, doll 10 may show image 34 on image display 20. Pressing record button 56 a second time may capture and/or store a video file on image memory 44. Pressing record button 56 a third time may stop capturing video. Pressing record button 56 a fourth time may resume capturing video. A user may press, hold, and release record button 56 to power-off doll 10.

After powering on doll 10, a user may press play button 58 to access and view a first stored and/or captured video file on image display 20. Pressing play button 58 a second time may pause a video file, and a third press of play button 58 may resume a paused video file. Pressing and holding play button 58 may allow access to a second stored and/or captured video file.

While doll 10 is powered-on, pressing trash button 54 may delete a stored and/or captured video, however doll 10 may display a prompt on image display 20 to confirm deletion, pressing trash button 54 a second time may confirm deletion and cause a video file to be purged from image memory 40 making additional memory available.

During operation, image display 20 may provide a user with visual representations to communicate functions that may be performed or are being performed. For example, a miniature camcorder may appear in a lower right corner of image display 20 to indicate image sensor 40 is ready to record. Once recording begins, image display 20 may display record time along with a flashing record symbol. Additionally, image display 20 may display a low battery, low memory, and/or delete memory graphic during operation. In some embodiments, additionally and/or alternatively, doll 10 may include a LED that may flash different flashing patterns if an interactive toy doll has either low memory or low battery power. Moreover, before a video is viewed/played image display 20 may display a unique file name associated with each video to indicate which video is being viewed/played.

Moving on from control panel 22, FIG. 3 additionally shows an electrical connector 62 that may be integrated into torso 14 and operatively connected to processor 42. Electrical connector 62 may be a mini-USB, mini-HDMI, mini-DVI or similar interface and may be capable of performing such functions as 1) outputting image 34 or stored data files from image memory 44 to a computer, a TV, or a similar audio and/or visual device; 2) inputting image 34 or other data files onto image memory 44; 3) inputting a software and/or firmware update to doll 10; or 4) charging power-source 50.

As discussed above, electrical connector 62 may be used for connecting doll 10 to a computer, which may allow a user to edit captured audio and visual information using software located on any or all of memory inside doll 10, memory inside a computer, a CD-ROM (or similar data storage device) or on the Internet. In some embodiments, however, doll 10 may include software and/or additional manual inputs to allow editing without a computer. This may allow a user to view and edit video directly after capturing video.

Editing Tools may include: Timeline edit, Filters, Graphics, and Dubs. Using timeline edit, a user may be able to edit the length, order, and speed of captured audio and/or visual information. Using filters, a user may be able to filter captured images and/or video files by, for example, warping, applying black and white filters, and/or applying sepia tone filters. Using graphics, a user may be able to drop in thought bubbles, popping hearts, and other graphical elements. Using dubs, a user may be able supplement captured audio information and/or video files with sound effects that may be included in a bank of sound effects. Additionally, a user may be able supplement captured audio information and/or video files with user recorded sounds or videos. After editing is complete, a user may share video files with other users.

Figure 4:
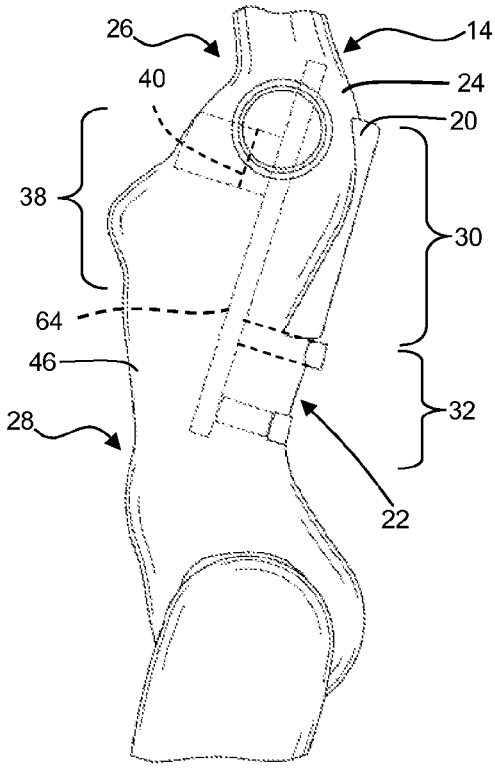
FIG. 4 is a side view of a of a torso region of the doll of FIGS. 1 and 2.

FIG. 4 shows a side view of torso 14 including front portion 46 and back portion 24. Torso 14 may include upper portion 26 and lower portion 28. Starting from lower portion 28 and ascending to upper portion 26, back portion 24 may include a lumbar region 32 and a thoracic region 30. Thoracic region 30 may be generally aligned with sternum region 38 located on front portion 48. Image display 20 may be integrated into thoracic region 30. Control panel 22 may be integrated into lumbar region 32, and may include one or more manual inputs 52. Additionally, control panel 22 and image display 20 may be operatively connected to image sensor 40 by a printed wiring assembly 64.

In some embodiments, doll 10 may include a separate miniature video camera capable of capturing audio, moving images, and still images. A user may use miniature video camera by itself to capture and view video of doll 10, or a user may attach miniature video camera to a slot located on back portion 24 of torso 14 to capture and view video from a perspective of doll 10. After attachment, an image sensor on the miniature video camera may be generally aligned with camera lens 36.

In some embodiments, additionally and/or alternatively, doll 10 may include a detachable image display capable of attachment to back portion 24 of torso 14. Detachable image display may be disguised as a jacket, backpack, or purse allowing a user to accessorize and/or change the appearance of doll 10.

In some embodiments, doll 10 may additionally and/or alternatively include a separate pair of glasses with an embedded image display that may be remotely connected to image sensor 40. Glasses may be worn to view images from a perspective of doll 10. Additionally and/or alternatively, in some embodiments doll 10 may include a headphone jack for audio output.

Figure 5:
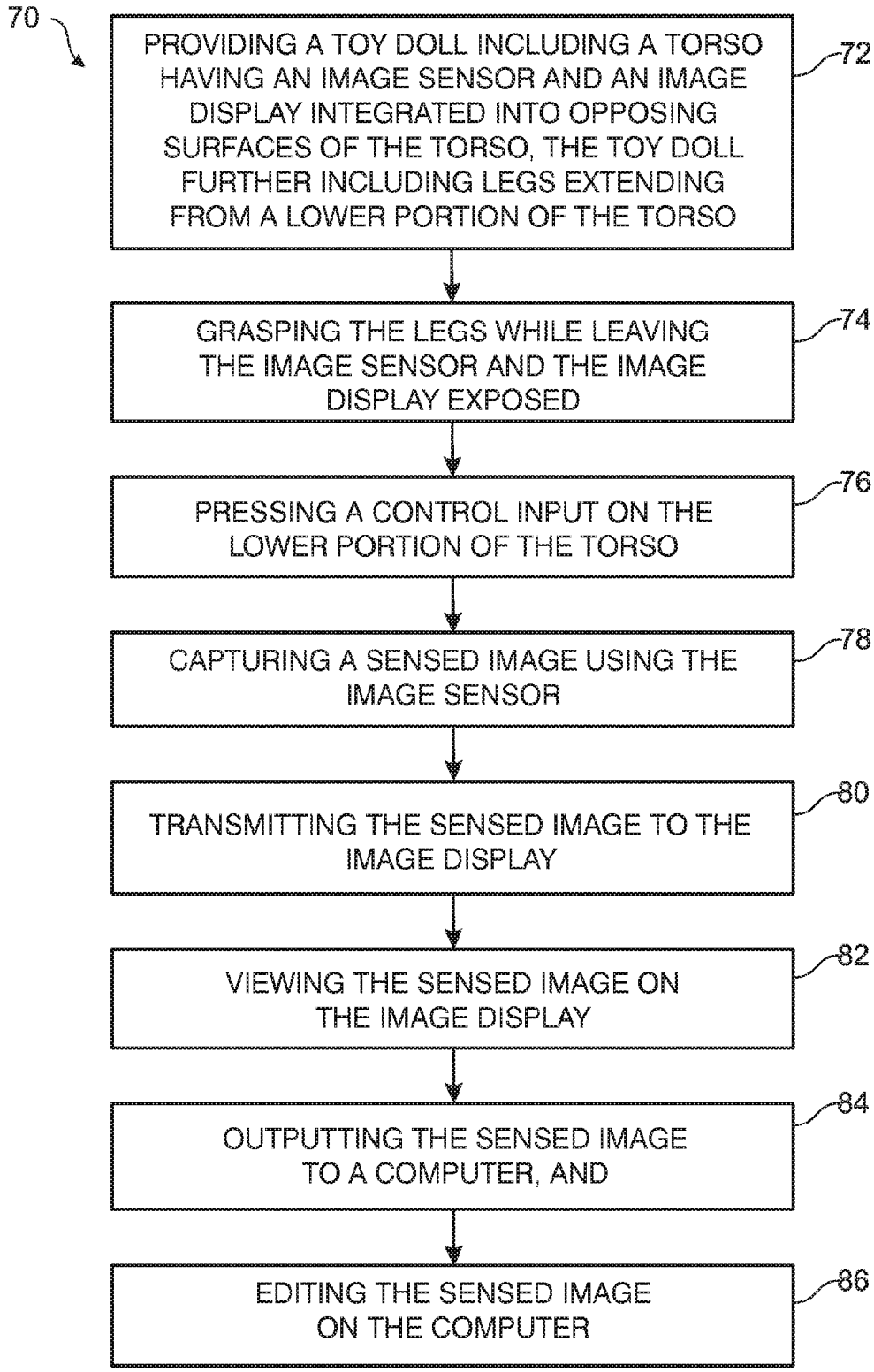
FIG. 5 is a flowchart depicting a nonexclusive illustrative example of a method of playing with an interactive toy doll.

As shown in FIG. 5, the present invention may include methods of playing with an interactive toy doll according to the present disclosure. As shown in flowchart 70, such methods may include providing a toy doll including a torso that may have an image sensor and an image display integrated into opposing surfaces of the torso, with legs extending from a lower portion of the torso at 72; grasping the legs while leaving the image sensor and the image display exposed at 74; pressing a control input on the lower portion of the torso at 76; capturing a sensed image using the image sensor at 78; transmitting the sensed image to the image display 80; viewing the sensed image on the image display at 82; outputting the sensed image to a computer 84; and editing the sensed image on the computer at 86.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A toy doll comprising:

a torso including a sternum region located on a front portion of the torso;

a thoracic region located on a back portion of the torso, generally aligned with the sternum region;

a lumbar region located on the back portion of the torso, generally below the thoracic region;

a camera lens integrated into the sternum region;

an image sensor supported inside the torso and optically connected to the camera lens;

an image display integrated into the thoracic region and operatively connected to the image sensor;

a control panel integrated into the lumbar region, operatively interconnected to the image sensor and the image display, and including at least one manual input so that the image sensor and the image display may be controlled using the control panel.

2. The toy doll of claim 1, further including a microphone integrated into the sternum region and operatively connected to the image sensor.

3. The toy doll of claim 1, further including a processor operatively connected to the image sensor and the image display.

4. The toy doll of claim 3, further including an image memory operatively connected to the processor.

5. The toy doll of claim 3, further including an electrical connector integrated into the torso and operatively connected to the processor.

6. The toy doll of claim 3, further including a power source operatively connected to the processor.

7. The toy doll of claim 6, further including at least one leg, wherein the power source is housed in the at least one leg.

8. The toy doll of claim 1, further including:

legs extending from a lower portion of the torso;

wherein the legs may be grasped by a user while leaving the camera lens and the image display exposed so that a user may view an image on the image display while grasping the legs.

9. A method of playing with a toy doll, the method comprising the steps of:

providing a toy doll, where the doll includes a torso including a sternum region located on a front portion of the torso;

legs extending from a lower portion of the torso;

a thoracic region located on a back portion of the torso, generally aligned with the sternum region;

a lumbar region located on the back portion of the torso, generally below the thoracic region;

a camera lens integrated into the sternum region;

an image sensor supported inside the torso and optically connected to the camera lens;

an image display integrated into the thoracic region and operatively connected to the image sensor; and a control panel integrated into the lumbar region, operatively interconnected to the image sensor and the image display, and including at least one manual input so that the image sensor and the image display may be controlled using the control panel;

grasping the legs while leaving the image sensor and the image display exposed;

pressing the manual input on the control panel;

capturing a sensed image using the image sensor; transmitting the sensed image to the image display;

viewing the sensed image on the image display;

outputting the sensed image to a computer; and editing the sensed image on the computer.

10. The method of playing with a toy doll of claim 9, further including the steps of providing a processor operatively connected to the image sensor and the image display.

11. The method of playing with a toy doll of claim 10, further including the steps of providing an image memory operatively connected to the processor.

12. The method of playing with a toy doll of claim 10, further including the steps of providing a power source housed in at least one of the legs and operatively connected to the processor.

13. The method of playing with a toy doll of claim 10, further including the steps of providing a microphone integrated into the sternum region and operatively connected to the image sensor.

* * * * *